US007510247B2

(12) United States Patent
Pirilä

(10) Patent No.: US 7,510,247 B2
(45) Date of Patent: Mar. 31, 2009

(54) ICE RESURFACING MACHINE AS WELL AS SYSTEM AND METHOD FOR ICE MAINTENANCE

(75) Inventor: Timo Pirilä, Kalanti AS (FI)

(73) Assignee: Kalannin Kaspek Oy, Kalanti AS (FI)

( * ) Notice: Subject to any disclaimer, the term of this patent is extended or adjusted under 35 U.S.C. 154(b) by 240 days.

(21) Appl. No.: 10/549,186

(22) PCT Filed: Mar. 17, 2004

(86) PCT No.: PCT/FI2004/000151

§ 371 (c)(1),
(2), (4) Date: May 22, 2006

(87) PCT Pub. No.: WO2004/083528

PCT Pub. Date: Sep. 30, 2004

(65) Prior Publication Data

US 2006/0226695 A1 Oct. 12, 2006

(30) Foreign Application Priority Data

Mar. 17, 2003 (FI) ..... 20030398
Mar. 17, 2003 (FI) ..... 20030399

(51) Int. Cl.
*E01H 4/02* (2006.01)

(52) U.S. Cl. ..... 299/1.5; 299/24

(58) Field of Classification Search ..... 299/1.05, 299/1.4, 1.5, 24
See application file for complete search history.

(56) References Cited

U.S. PATENT DOCUMENTS

| | | | | |
|---|---|---|---|---|
| 652,311 | A | 6/1900 | Hourihan | |
| 2,642,679 | A | 6/1953 | Zamboni | |
| 3,044,193 | A | 7/1962 | Zamboni | |
| 4,107,859 | A | 8/1978 | Keith | |
| 4,537,259 | A | 8/1985 | Funabashi et al. | |
| 5,044,446 | A | 9/1991 | Jonasson et al. | |
| 5,897,603 | A | 4/1999 | Henderson | |
| 5,917,593 | A | 6/1999 | Hirano et al. | |
| 5,944,764 | A | 8/1999 | Henderson et al. | |
| 6,029,752 | A | 2/2000 | Young | |
| 6,916,070 | B2 * | 7/2005 | Sehr | 299/1.5 |
| 2003/0000239 | A1 * | 1/2003 | Dawe et al. | 299/24 |

FOREIGN PATENT DOCUMENTS

DE 35 36 974 A1 4/1987

(Continued)

OTHER PUBLICATIONS

International Search Report dated Jun. 21, 2004.
Written Opinion of the International Searching Authority dated Jun. 21, 2004.

(Continued)

*Primary Examiner*—John Kreck
(74) *Attorney, Agent, or Firm*—Buchanan, Ingersoll & Rooney PC

(57) ABSTRACT

The invention comprises an ice resurfacing machine (1) as well as a system and method for maintenance of ice (3). According to the invention, location of the ice resurfacing machine, properties of the environment of the ice (3) or the position of a blade (15) of a scraper is monitored and received signals are utilized for controlling the ice resurfacing machine or the position of its blade (15).

18 Claims, 4 Drawing Sheets

FOREIGN PATENT DOCUMENTS

| | | | |
|---|---|---|---|
| EP | 0 797 075 | A2 | 9/1997 |
| EP | 1 079 029 | A2 | 2/2001 |
| FI | 88949 | | 12/1989 |
| WO | 02/093106 | A1 | 11/2002 |
| WO | 02/097198 | A1 | 12/2002 |

OTHER PUBLICATIONS

Finnish Office Action dated Jan. 14, 2004 with Finnish Search Report in Patent Application No. 20030398 dated Jan. 13, 2004.
Finnish Office Action dated Jan. 14, 2004 with Finnish Search Report in Patent Application No. 20030399 dated Jan. 13, 2004.

* cited by examiner

ICE RESURFACING MACHINE AS WELL AS SYSTEM AND METHOD FOR ICE MAINTENANCE

This application is the U.S. National Stage Application Under 35 U.S.C. § 371 of International Application No. PCT/F12004/000151 filed on Mar. 17, 2004 designating the U.S., and claims priority under 35 U.S.C. § 119 with respect to Finnish Application Nos. 20030399 filed on Mar. 17, 2003 and 20030398 filed Mar. 17, 2003, the entire contents of all of which are hereby incorporated by reference.

TECHNICAL FIELD OF THE INVENTION

The object of the invention is an ice resurfacing machine, a system and a method for maintenance of ice according to the preambles of the independent claims presented below. The invention relates especially to a new manner of controlling an ice resurfacing machine and its operation.

PRIOR ART

Typical ice resurfacing machine is driven on ice. The machine has a scraper, working depth of which can be controlled, that is the amount of ice to be removed by the scraper. Typically, the removed ice is collected into a tank of the machine. Furthermore, the ice resurfacing machine usually has a water tank and means for feeding desired amount of water on the ice that already has been maintained by the machine. In known ice resurfacing machines the ice scraping depth and the amount of water to be fed are adjusted more or less approximately.

The known ice resurfacing machines are conventionally controlled manually for example by a steering wheel. Ice to be maintained, for example that of an ice hockey rink, is usually driven time after time approximately along the same paths. Usually, quality of ice varies in different places of the rink. Different places of the ice require different measures, for example scraping in different depths.

Conventionally, working quality depends on the skills and alertness of the user of the ice resurfacing machine. Therefore, also quality of the maintained ice varies sometimes a lot even in different places of the same rink.

Patent publication WO 02/097198 discloses an ice resurfing machine whose movement is controlled by means of a positioning signal.

It is an aim of the present invention, for instance, to reduce or even eliminate the above-mentioned problems of the prior art.

It is an aim of the present invention especially to provide a solution that is more precise, easier to use, more reliable and efficient than previous ice resurfacing machines.

BRIEF DESCRIPTION OF THE INVENTION

To attain the above purposes among other things, the ice resurfacing machine as well as the system and the method for ice maintenance according to the invention are characterized in what will be presented in the characterizing parts of the appended independent claims.

The exemplary applications and advantages mentioned in this text apply, when applicable, to the ice resurfacing machine as well as to the system and method according to the invention, even though it is not always specifically pointed out.

The invention is suitable for use with various ice resurfacing machines. According to some applications of the invention, it is applied to some of the ice resurfacing machines disclosed in the following patent publications: U.S. Pat. Nos. 652,311, 2,642,679, 3,044,193, WO 02/093106, WO 02/097198

In a typical advantageous method for ice maintenance according to the invention, desicions on the ice scraping depth and place are made mechanically. A computer, for example, which is programmed to process signals from different sensors or controllers, can be used for this purpose. Results of the made decisions are transferred as electrical control signals to the scraper or to means controlling its position. In practise, the control signal is thus delivered as an electric current, for example, to a spindle motor that controls position of the scraper, and which then moves the scraper to a desired direction. According to the invention, mechanical decision can be bypassed manually, if desired. Manual control is necessary for example in a so-called unusual ice maintenance situation, for example in highly demanding circumstances, driving over a block or in emergency. Typically, in the invention, position of a blade is monitored with a sensor coupled to power means controlling it or to the blade itself. The signal developed by the sensor and indicating position of the blade is transmitted to the control means of the power means, that is, for example to said computer. In normal ice maintenance situation, decisions on the ice scraping depth are made taking into consideration the signal developed by the sensor and indicating position of the blade.

In an application of the invention, the user of the ice resurfacing machine changes adjustments of the machine deciding on controlling. Matters to be changed can be, for example, minimum and maximum permitted scraping depth. Such adjustments are advantageously set from a control panel placed in a cabin of the ice resurfacing machine. Changes can thus be made fast and easily as soon as need for change of the adjustments is noticed.

A typical advantageous ice resurfacing machine according to the invention comprises

- means for monitoring the shape of the ice surface, for example a mechanical sensor monitoring the ice surface,
- a blade, which is arranged to scrape the ice, and
- means for controlling position of the blade for achieving desired scraping result.

Typical means according to the invention for controlling position of the blade comprise

- a power means, such as a spindle motor, coupled to the blade for moving the blade, and
- a sensor coupled to the power means and/or to the blade, and arranged to be monitoring the blade position.

Furthermore, typical means for controlling position of the blade comprise

- control means of the power means for making mechanical controlling decisions and for creating control data of the power means, and
- electrical communication transfer means for transferring a signal from the sensor monitoring the position of the blade to the control means of the power means, and
- electrical means for transferring the control data obtained by the control means to the power means.

In other words, a typical advantageous ice resurfacing machine according to the invention comprises control means of the power means, such as a computer with its programs that make controlling decisions for the scraper based on the data provided for them. This data can be entered from one or more different sensors, but also manually, from the control panel switches of the ice resurfacing machine, for example. A typical ice resurfacing machine according to the invention comprises a sensor that monitors position of the blade and means for transmitting the data provided by the sensor to the control means of the power means.

A typical application of the ice resurfacing machine according to the invention comprises also a water container and means for guiding water on the ice. Preferably also their operation, that is at least the amount of water fed on the ice, is controlled mechanically according to the invention. Control means of the power means according to the invention can be arranged to make mechanical controlling decisions also on other actuators of the ice surfacing machine. Control means of the power means can also take care of sending thus created controlling signals to other actuators of the ice surfacing machine. Such other actuators can be, for example, means for changing travel direction of the ice resurfacing machine or means for adjusting its speed.

In a very advantageous ice resurfacing machine according to the invention the control means of the power means comprise means for adjusting the minimum and maximum scraping depth of the blade as desired. These means are for example potentiometers that are reliable and easy to use. Of course, they can also be any other appropriate means. In case the potentiometer has an adjusting device that can be turned manually, it is easy to be placed as one of the switches in the control panel of the ice resurfacing machine cabin. Advantage of the possibility to adjust the minimum and maximum surfacing depth is that by means of them the scraper of the ice resurfacing machine can easily be calibrated to appropriate position for example on the ice resurfacing machine or on the scraper after maintenance. By means of the minimum value, the minimum depth of the layer to be removed from the ice surface is controlled, and by means of the maximum value, scraping off a too thick layer is prevented. Very advantageously, the means coupled to the control means of the power means for adjusting the minimum and maximum scraping depth are remote controlled. More advantageously also other control units of the ice resurfacing machine having effect on the scraping depth of the blade are remote controlled. Thus, they can be placed, for example, in the cabin of the ice resurfacing machine, making thereby the task more comfortable and fast.

According to an application, the means for monitoring shape of the ice surface comprises a receiver for a signal to be sent outside the ice resurfacing machine. Said signals to be transmitted from outside are led from the signal receiver to the control means of the power means preferably by electrical communication transfer means. By such system, the machine can be provided with exact data about the height position of the machine, for example. Such advantageous system is disclosed, for example, in the earlier international publication WO 02/093106 by the applicant. Advantageousness of the invention in question is further improved if a laser beam transmitter and/or a laser receiver is connected to it. The transmitter is advantageously placed outside the ice resurfacing machine and the receiver is placed advantageously in the ice resurfacing machine. By means of such laser system, the control means of the power means according to the invention are provided with exact data about each height position of the ice resurfacing machine.

Typical ice resurfacing machine according to another point of view of the invention comprises means for receiving or transmitting a positioning signal. One application of the ice resurfacing machine according to the invention further comprises means for observing properties of the environment or the ice it has attended, such as ice thickness, ice or air temperature or ice structure. One application of the ice resurfacing machine according to the invention further comprises communication transfer means for transmitting the properties of the ice or the environment observed in different places of the ice for further processing.

Typical system for ice maintenance according to the invention comprises the ice resurfacing machine and, in addition, means for positioning the ice resurfacing machine, means for forming positioning data that reveals location of the ice resurfacing machine, and memory means for storing the formed positioning data. One application of the system for ice maintenance according to the invention further comprises means for observing properties of the environment or the ice it has maintained, such as ice thickness, ice or air temperature or ice structure, and means for storing the observed properties of the ice to electrical memory means. Thus, the properties observed in a certain location are stored according to their observation place. One application of the system for ice maintenance according to the invention further comprises means for forming control data for the ice resurfacing machine on the basis of the properties observed in certain observation places. One application of the system for ice maintenance according to the invention further comprises means for transmitting to the ice resurfacing machine the formed control data for the ice resurfacing machine.

In a typical method for maintenance of ice according to the invention the ice is maintained with an ice resurfacing machine, the location of the ice resurfacing machine is monitored with positioning method and the location of the ice resurfacing machine is registered in an electrical data base. Furthermore, in a method according to the invention, properties of the environment or of the ice maintained by the ice resurfacing machine, such as ice thickness, ice or air temperature or ice structure are observed and registered in an electrical memory. In a method according to the invention it is further formed control data for the ice resurfacing machine on the basis of the properties observed in observation places and the positioning data registered in the electrical memory, and the ice resurfacing machine is controlled on the basis of the formed control data.

Typical functions of the ice resurfacing machine that are controlled by means of the invention are the travel direction and travel speed of the ice resurfacing machine, the surfacing depth of the ice resurfacing machine blade, and the amount of water fed on the maintained ice by the ice resurfacing machine. The invention can be used for controlling all the above mentioned functions precisely according to the need of each place in the ice.

The ice resurfacing machine receives typically a positioning signal transmitted from outside the machine. Therefore, the ice resurfacing machine has to be provided with a receiver for the positioning signal. The positioning can be arranged for example by means of a conventional GPS system or by some other available positioning method.

By means of a receiver for the positioning signal the control means of the power means are provided with exact data about each horizontal positioning or, for example, speed of the ice resurfacing machine. Such ice resurfacing machine can easily be arranged to function even with out a driver. The positioning data is preferably stored in a computer or the like, whereby the data can efficiently be processed. Thereby, different data varying according to the location of the ice resurfacing machine, can be added to the positioning data. Information on the ice thickness in different places of the ice stadium can be, for example, stored in the database to be formed. Thus, the computer can automatically design different treatments for the maintenance of the rink. For instance, when the ice resurfacing machine reaches a place in the ice that is in poor condition or where ice is especially thick, for example, the ice resurfacing machine can start to scrape deeper and, for example, to increase gradually the amount of water already before the poorest place. Thus, an even result will be obtained. Such ice resurfacing machine has preferably auxiliary devices for monitoring the environmental conditions, such as devices for sensing air and/or ice temperature, for example a thermal camera. Thereby, conditions in different parts of the ice stadium, that vary due to the irregular lightning or ventilation, could be stored in the memory. Due to the heating effect of the lightning, for example, some part of the ice may need a slightly thicker layer of ice in order to keep the ice of an uniform quality during an ice-hockey match, for example.

The better the ice and environmental conditions are known, the better the operation of the ice resurfacing machine can be worked out. The system according to the invention can also be used for compiling useful information on how to change ventilation or lightning of the ice stadium, or the operation of the ice resurfacing machine in the rink, for example.

The ice resurfacing machine and the system according to the invention as well as the control means of the power means according to the invention, comprise preferably means for processing automatically the data created by the system and transferred to the control means, and for transmitting thus formed control data automatically to the controllable actuators of the ice resurfacing machine, such as power means. The system and/or the control means can comprise for example a computer, which has memory means and a stored computer program code to be processed to the memory, for example. Thus, the program code comprises program code elements that are arranged to attend to the measures required for making mechanical controlling decisions according to the invention. Such program code can easily be programmed, if a man skilled in the art provides programmer with required information on what basis the ice scraping depth, the amount of water to be fed on the ice, the speed of the ice resurfacing machine or the direction of the ice resurfacing machine, for example, should be controlled.

The most important advantages of the invention are the savings attained in maintenance costs and energy. The ice can be kept thin, when desired, whereby its freezing machinery needs less power supply. Ice maintenance becomes faster and ice is more plane and more even in quality in different parts of the field than before. By means of the invention, controlling of the scraper is more precise, because more information is obtained on the environment, for instance on ice, air and also on the state of the ice resurfacing machine, and also in more real time compared with previous solutions. By means of the invention, changes in the controlling parameters of the ice resurfacing machine can be made fast and easily. The ice resurfacing machine according to the invention can easily be arranged to function even with out a driver. In addition to the savings in operating expenses, a further advantage in this would be, among other things, that the ice resurfacing machine could be designed advantageous clearly in view of its operation.

BRIEF DESCRIPTION OF THE FIGURES

In the following, the invention will be described in more detail with reference to the appended drawing, in which.

DESCRIPTION OF THE ADVANTAGEOUS EMBODIMENTS OF THE INVENTION

Figure 1:
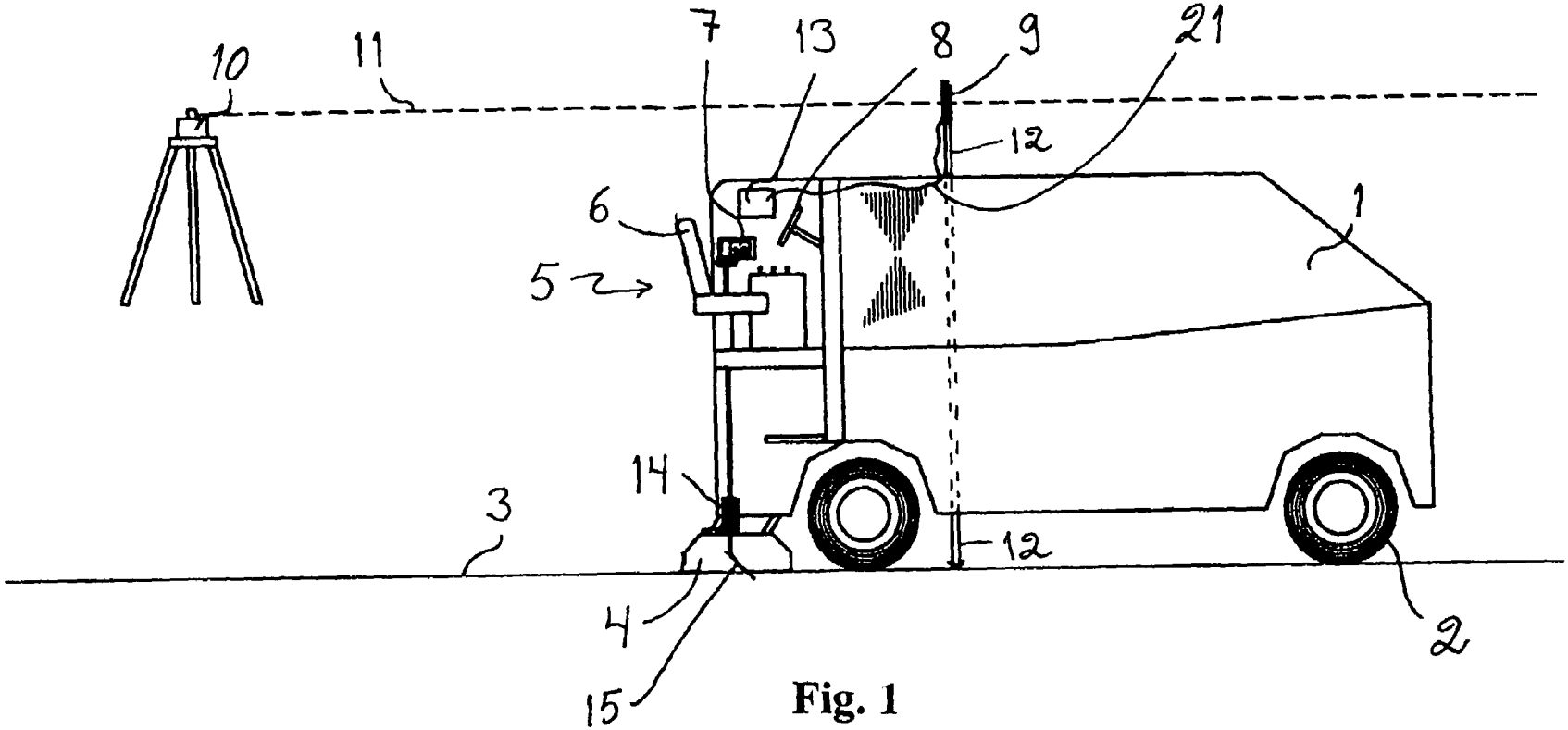
FIG. 1 shows schematically the ice resurfacing machine and system according to the invention

FIG. 1 shows an ice resurfacing machine 1 according to the invention. The machine 1 of the figure stands on the ice 3 supported by its wheels 2. The ice resurfacing machine 1 comprises a scraper 4 mounted on its rear part, against the ice 3. The scraper 4 has to be moved so that its scraping depth can be adjusted as desired. The ice resurfacing machine has a cabin 5 that is intended for the driver, and that has a driver's seat 6. The cabin 5 has a control panel 7 as well as a steering wheel 8. The ice resurfacing machine comprises a laser receiver 9, by means of which a laser beam 11 transmitted by laser transmitter 10 is received. The laser receiver 9 is supported directly to the ice 3 by a bar 12. The bar 12 can be attached to the ice resurfacing machine 1 for example by sleeve-like joints, which allow the bar mounted inside them to move in vertical direction. This way, also the receiver 9 moves in vertical direction along the shape of the surface of the ice 3. The laser beam 11 hits the receiver 9 in different height according to this movement. The receiver 9 produces different signal when the laser beam 11 hits the receiver 9 in different height. Thus, by means of this signal, variations in the surface of the ice 3 are determined precisely and fast. This technique is described in more detail for example in the publication WO 02/093106.

Also control means 13 of the position of the scraper 4 according to the invention is placed in the cabin. A computer or some simple logic circuit, for example, can function as the means 13. It is programmed to process the given data according to each need, such as the signal from the laser receiver 9, and to convert this data into a control signal of the apparatus 14 controlling the position of the scraper 4.

Figure 2:
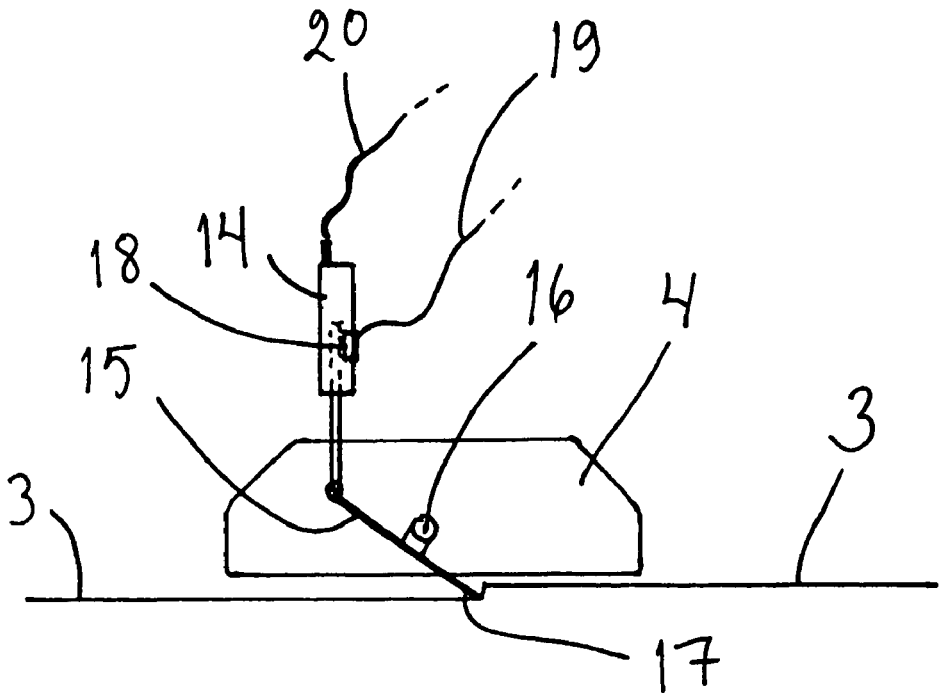
FIG. 2 shows schematically the scraper of ice resurfacing machine according to the invention and some devices coupled to it.

Position of the scraper 4 is controlled by a spindle motor 14. It can be seen better in FIG. 2. The blade 15 of the scraper is hinged to turn around a substantially horizontal axis 16. When the spindle motor 14 is elongated, the scraping front edge 17 of the blade 15 moves upwards, whereby the scraping depth decreases. When the spindle motor 14 is shortened, the scraping front edge 17 of the blade 15 respectively moves donwnwards, whereby the scraping depth increases. A sensor 18 that monitors position of the spindle motor, and that continuously transmits signal to the control means 13 along a conductor 19, is mounted on the spindle motor. Thereby, the control means 13 is constantly aware of each scraping depth. This information can thus constantly be utilized in controlling the blade 15 in order to attain precise control. The control means 13 transmits the control signal of the spindle motor along the electric wires 20. Wires 19 and 20 are not shown in FIG. 1 for the sake of clarity. The data transmitted from the laser receiver 9 to the control means 13 is led along the wire 21 schematically drawn in the FIG. 1. Communication transmitted by the wires 19, 20 and 21 can be arranged also wireless with some prior art arrangement.

Figure 3:
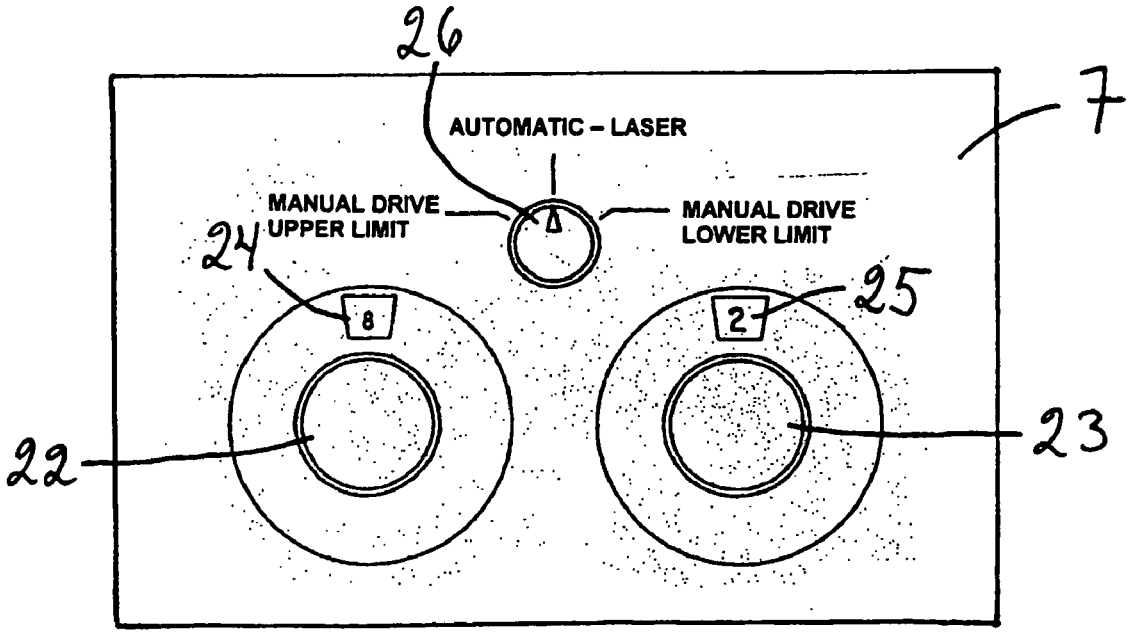
FIG. 3 shows schematically the control panel of the ice resurfacing machine according to the invention

FIG. 3 shows manual adjusters 22 and 23, mounted on the control means 13 and placed in the control panel, for adjusting the minimum and maximum scraping depths. In the example of the figures they are carried out with potentiometers. Screens 24 and 25 are arranged in connection with the potentiometers 22 and 23 for a quick perception of the maximum and minimum scraping depth. In the situation of the figure, 8 mm is chosen as the maximum scraping depth and 2 mm as the minimum scraping depth. Between the potentiometers, there is a bar 26, by turning of which a laser-controlled automatic or manual drive can be chosen. The bar is now turned into intermediate position, that is, the machine is on the laser controlled automatic drive. Thus, the minimum scraping depth of the automatic control is set by the adjuster 23 and the maximum scraping depth by the adjuster 22. If the bar 26 is turned to the right, then it is continuously driven with the depth that is chosen by the adjuster 23, and if the bar 26 is turned to the left, then it is continuously driven with the depth that is chosen by the adjuster 22. When driving the ice resurfacing machine 1 provided with the control panel 7 shown in FIG. 3, the maximum and minimum scraping depth can be easily changed any time during the whole drive according to the need. Adjustment carried out by a potentiometer is stepless. The adjusters 22 and 23 as well as the screens 24 and 25 are easy to arrange very illustrative. The adjusters 22 and 23 as well as the screens 24 and 25 can be arranged in many different ways. The potentiometers can be replaced by press buttons, for example, and the screens by digital screens.

Figure 4:
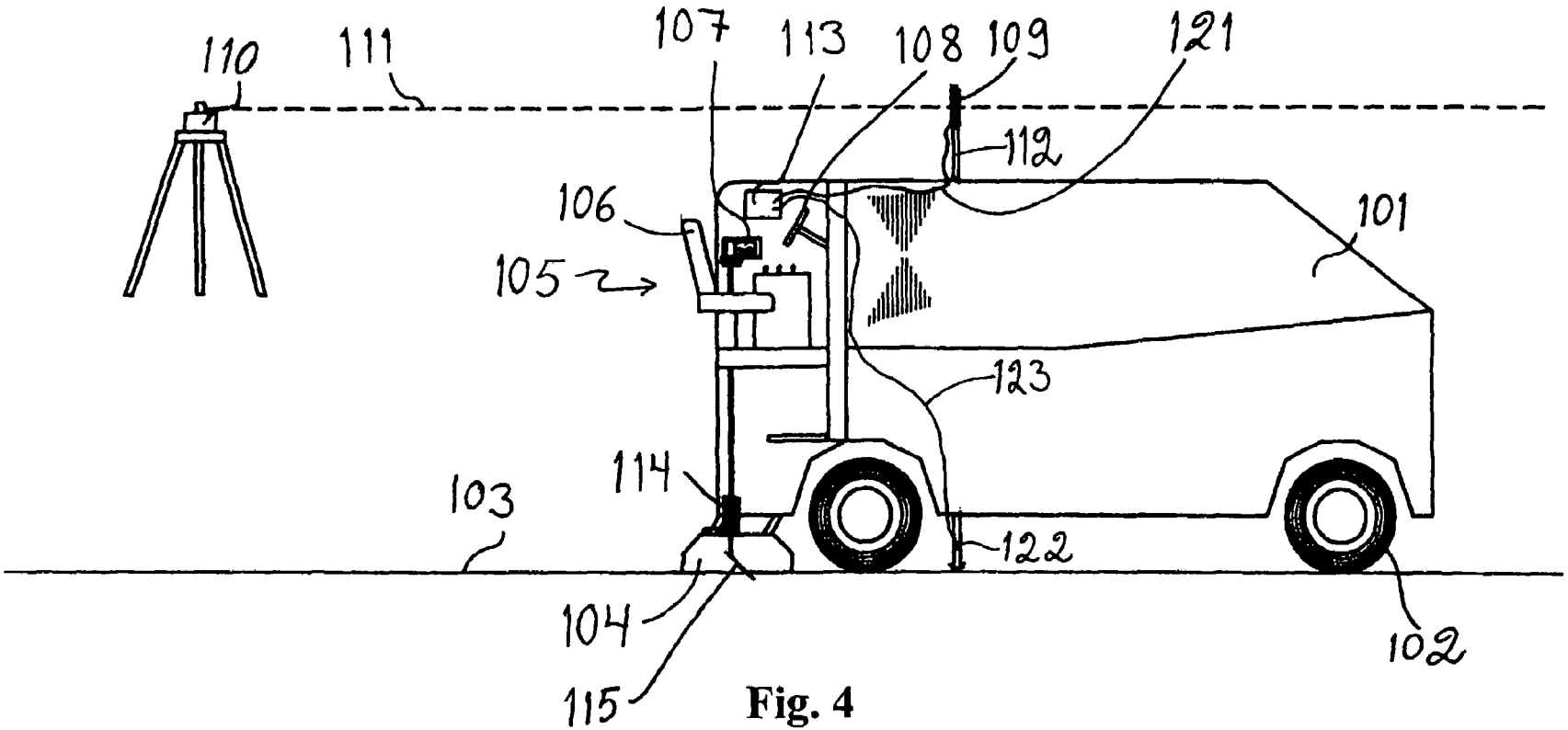
FIG. 4 shows schematically another ice resurfacing machine and system according to the invention.

FIG. 4 shows an ice resurfacing machine 101 according to the invention. The machine 101 of the figure stands on the ice 103 supported by its wheels 102. The ice resurfacing machine 101 comprises a scraper 104 mounted on its rear part against the ice 103. The scraper 104 has to be moved so that its scraping depth can be adjusted as desired. The ice resurfacing machine has a cabin 105 that is intended for the driver, and that has a driver's seat 106. The cabin 105 has a control panel 107 as well as a steering wheel 108. The ice resurfacing machine comprises a laser receiver 109 of a positioning signal, by means of which positioning signal 111 transmitted by a transmitter 110 can be received. The receiver 109 is supported to the ice resurfacing machine 101 by a bar 112. A sensor 122 is placed against the ice, on the lower part of the ice resurfacing machine. It continuously measures thickness and temperature of the ice 103 as well as air temperature.

Also a computer 113 according to the invention is placed in the cabin. The data from the receiver 109 to the computer 113 is led along the wire 121 schematically drawn in the FIG. 4. Measurement data of the sensor 122 are transmitted to the computer 113 via the wire 123. Data transmission can be arranged also wireless with a prior art arrangement. The computer 113 is programmed to process the given data, according to each need, that is the signals transmitted from the positioning signal receiver 109 and the sensor 122, and to convert this data into control commands of different actuators of the ice resurfacing machine 101. The controllable actuators are, for example, the spindle motor 114 controlling the position of the blade 115 of the scraper 104, that is the scraping depth of the scraper, position and rotating speed of the wheels 102, that is the travelling direction and travelling speed of the ice resurfacing machine 101, and the position of a valve (not shown) adjusting the amount of water fed on the ice.

It is also possible to control the ice resurfacing machine 101 according to the invention conventionally by manual control. Automatism is switched off from the switch located in the control panel 107, for example. After this, the machine can be controlled by means of the steering wheel 108 or other conventional control devices.

Figure 5:
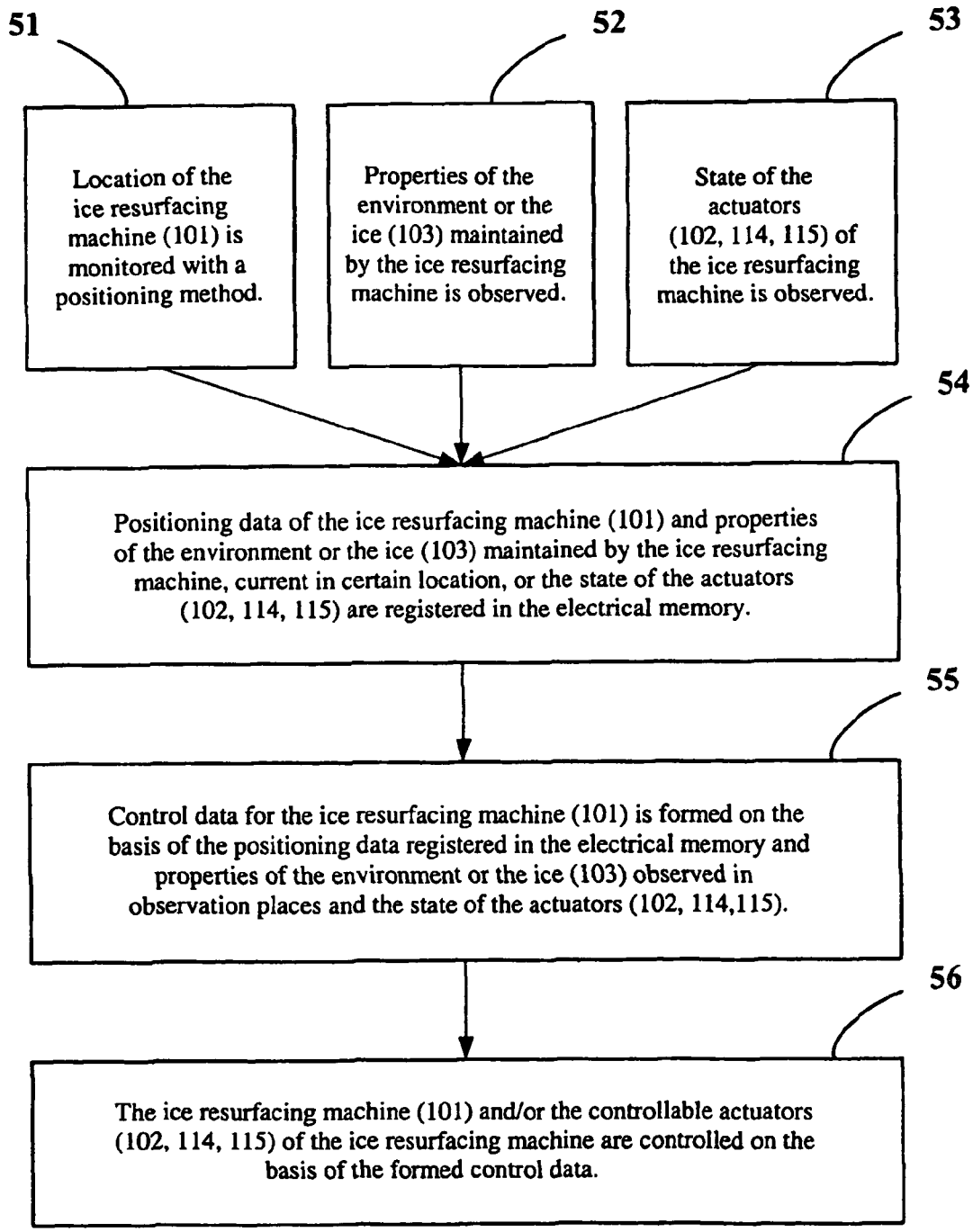
FIG. 5 shows steps of one method according to the invention in a simplified flow chart.

FIG. 5 shows the steps of the method for maintenance of the ice according to the invention. At stage 51 the location of the ice resurfacing machine (101) is monitored with a known positioning method. At stage 52 the properties of the environment or the ice (103) maintained by the ice resurfacing machine are observed. Properties to be observed can be, for example, thickness of the ice, ice temperature, air temperature. At stage 53 the state of the actuators (102, 114, 115) of the ice resurfacing machine is observed. These states of the actuators can be, for example, position of the blade 115, that is the scraping depth of the scraper, position and rotating speed of the wheels 102 and the amount of water to be fed on the ice, that is the position of the valve (not shown) adjusting the outcoming water to be fed. One or more functions of the stages 51, 52 and 53 can be in use. It is possible, for example, for the system or the ice resurfacing machine according to the invention not to comprise sensors required by the stage 52 for monitoring the environment, or that they can be switched off, if desired.

At stage 54, the information observed in stages 51-53 is registered in an electrical database. The observed information is entered in the database so that it is arranged according to the observation place of the stage 51.

In stage 55, control data for the ice resurfacing machine (101) is formed on the basis of the position data and the properties of the ice (103) or the environment observed in observation places, and the states of the actuators (102, 114, 115) registered in the database. In places where the ice is warmer than its surrounding, for example, the ice is likely also softer. The ice is thinner in some places than in others. If desired, these softer or thinner places can be coated with a slightly thicker ice layer than in other places. Also the data stored during previous maintenance can be used in forming control data. During an ice-hockey match, for example, it is typical that the ice worns out and softens more in certain places than in others, usually in front of the goals and the player's bench. In stage 56, a thicker layer of the worn ice can automatically be scraped off in these places, and a bigger amount of water than normally can be fed into these places.

In this application, several new solutions are presented for the ice resurfacing machine, such as

- a sensor monitoring position of the blade,
- means for adjusting minimum and maximum scraping depth of the blade as desired
- a receiver for a signal to be transmitted from outside the ice resurfacing machine
- means for positioning the ice resurfacing machine
- means for observing properties of the surroundings or the ice it has maintained
- means for forming positioning data that reveals location of the ice resurfacing machine
- electrical memory means where observed and formed information can be stored for later processing according to the invention
- a program code, by means of which the measures according to the invention can be performed.

It is obvious, that the presented solutions can be used as different combinations that are not separately mentioned in the application. For example

- utilizing the positioning data and the properties observed with the sensors connected to them, and
- adjusting the minimum and maximum scraping depth of the blade as desired can be used simultaneously or separately.

Figures show only preferred embodiments according to the invention. Figures do not separately show matters that are irrelevant in view of the main idea of the invention, known as such or obvious for a man skilled in the art. Figures do not show, for example, several typical features for the ice resurfacing machines, such as means for removing the scraped ice from the front of the scraper or means for guiding water on the maintained ice with a scraper. It is obvious, that the system according to the invention can also be used for controlling of feeding water on the ice, for example. It is apparent to the man skilled in the art that the invention is not limited exclusively to the examples described above, but that it can vary within the frames of the claims presented below. The dependent claims present some possible embodiments of the invention, and they are not to be considered to restrict the scope of protection of the invention as such.

The invention claimed is:

1. Ice resurfacing machine which comprises means for monitoring shape of an ice surface, a blade, which is arranged to scrape the ice, and means for controlling position of the blade for achieving desired scraping result, which comprise power means coupled to the blade for moving the blade, and control means of the power means for forming control data of the power means, electrical means for transferring the control data obtained by the control means to the power means, a sensor coupled to the blade or to the power means, and arranged to be monitoring the position of the blade, wherein the means for controlling the position of the blade further comprise electrical communication transfer means for transferring a signal from the sensor to the control means of the power means, means for adjusting the minimum and maximum scraping depth of the blade.

2. Ice resurfacing machine according to claim 1, wherein the control means of the power means are arranged in a cabin of the ice resurfacing machine.

3. Ice resurfacing machine according to claim 1, wherein the means for adjusting the minimum and maximum scraping depth of the blade are electrical means.

4. Ice resurfacing machine according to claim 1, wherein the means for adjusting the minimum and maximum scraping depth of the blade are remote controlled.

5. Ice resurfacing machine according to claim 1, wherein the means for monitoring the shape of the ice surface comprise a receiver for a signal to be transmitted from outside the ice resurfacing machine.

6. Ice resurfacing machine according to claim 5, wherein it comprises electrical communication transfer means for transmitting the signal from the receiver to the control means of the power means.

7. Ice resurfacing machine according to claim 1, wherein it comprises a water container and means for guiding water on the ice.

8. Ice resurfacing machine according to claim 1, wherein the control means of the power means comprise means for processing automatically the data transferred to the control means, and for transmitting thus formed control data automatically to the power means.

9. Ice resurfacing machine according to claim 1, wherein it comprises means for receiving a positioning signal.

10. Method for maintenance of ice, in which method shape of the ice surface is monitored, decisions are made on how much ice is to be scraped, ice is scraped at desired depth, in normal ice maintenance situation, decisions on the ice scraping depth are made mechanically, position of the blade is monitored with a sensor coupled to a power means or to a blade, wherein in the method, furthermore, the signal developed by the sensor and indicating position of the blade is transferred to a control means of the power means, in normal ice maintenance situation, decisions on the ice scraping depth are made taking into consideration the signal developed by the sensor and indicating position of the blade.

11. Method for maintenance of ice, in which method shape of the ice surface is monitored, decisions are made on how much ice is to be scraped, ice is scraped at desired depth, in normal ice maintenance situation, decisions on the ice scraping depth are made mechanically, position of the blade is monitored with a sensor coupled to a power means or to a blade, wherein in the method, furthermore, the signal developed by the sensor and indicating position of the blade is transferred to a control means of the power means, in normal ice maintenance situation, decisions on the ice scraping depth are made taking into consideration the signal developed by the sensor and indicating position of the blade, location of the ice resurfacing machine is monitored with a positioning method location of the ice resurfacing machine is stored in an electrical data base the data on previous actions performed by the ice resurfacing machine in specific location, is observed and registered in the electrical database, decisions on the ice scraping depth in each situation are made taking into consideration the previous actions performed in specific location and registered in the electrical database.

12. Ice resurfacing machine according to claim 1, wherein it further comprises means for observing properties of the surroundings or the ice it has maintained.

13. Ice resurfacing machine according to claim 12, wherein it further comprises communication transfer means for transmitting the properties of the ice or the environment observed in different places of the ice for further processing.

14. Ice resurfacing machine according to claim 1, wherein the power means comprises a spindle motor.

15. Ice resurfacing machine according to claim 3, wherein the electrical means comprise potentiometers.

16. Ice resurfacing machine according to claim 4, wherein the means for adjusting the minimum and maximum scraping depth of the blade are remote controlled from the cabin of the ice resurfacing machine.

17. Method according to the claim 11, wherein the data on previous actions comprises scraping depth and the amount of water fed.

18. Ice resurfacing machine according to claim 12, wherein the properties of the surroundings or the ice comprise ice thickness, ice or air temperature or ice structure.

* * * * *